United States Patent [19]

Kreyenbuhl

[11] 4,365,821

[45] Dec. 28, 1982

[54] SKI BINDING

[75] Inventor: Armand Kreyenbuhl, Samoens, France

[73] Assignee: Adidas Fabrique de Chaussures de Sport, Landersheim, France

[21] Appl. No.: 796,239

[22] Filed: May 12, 1977

Related U.S. Application Data

[63] Continuation-in-part of Ser. No. 666,589, Mar. 15, 1976, Pat. No. 4,108,467.

[30] Foreign Application Priority Data

| | | | |
|---|---|---|---|
| Jul. 2, 1976 | [FR] | France | 76 20262 |
| Nov. 16, 1976 | [FR] | France | 76 34449 |
| Feb. 11, 1977 | [FR] | France | 77 03904 |
| Mar. 8, 1977 | [FR] | France | 77 06692 |
| May 3, 1977 | [FR] | France | 77 13355 |

[51] Int. Cl.[3] ..... A63C 9/00

[52] U.S. Cl. ..... 280/615; 36/117; 280/635

[58] Field of Search ..... 280/615, 614, 635, 611; 36/117, 118, 119, 120, 121

[56] References Cited

U.S. PATENT DOCUMENTS

| | | | |
|---|---|---|---|
| 3,603,606 | 9/1971 | Eie | 280/615 |
| 3,612,558 | 10/1971 | Kjellstrom | 280/615 |
| 4,004,823 | 1/1977 | Pyzel et al. | 280/615 |
| 4,082,312 | 4/1978 | Johnson | 280/615 |

FOREIGN PATENT DOCUMENTS

| | | | |
|---|---|---|---|
| 2504304 | 8/1975 | Fed. Rep. of Germany | 280/615 |
| 47443 | 5/1909 | Switzerland | 280/615 |
| 47968 | 12/1909 | Switzerland | 280/615 |

*Primary Examiner*—Joseph F. Peters, Jr.
*Assistant Examiner*—Milton L. Smith
*Attorney, Agent, or Firm*—Brisebois & Kruger

[57] ABSTRACT

A ski binding for a touring or cross country ski in which a front extension of the sole of the boot enters a region in an archplate of the same size as the extension. The archplate is fixed to the ski and a fastening element holds the extension in the archplate. The extension has beveled edges and a reduced thickness area to enhance flexing at a location between the boot tip and the archplate engaging part of the extension.

16 Claims, 27 Drawing Figures

SKI BINDING

This is a continuation-in-part of my copending application Ser. No. 666,589, filed Mar. 15, 1976, now U.S. Pat. No. 4,108,467 issued Aug. 22, 1978 and the disclosure of which I incorporate into this application by reference.

This invention relates to a ski binding which secures a boot to a ski, particularly a touring or cross country ski. The binding is the type in which the boot is held by a front extension of the sole of the boot, and which enters into an archplate secured to the ski, and defining a space whose form corresponds in width and in height to that of the sole extension. The boot is secured to the ski by a fastening means which secures the sole extension in the archplate. This fastening means assures a good binding of the boot on the ski while giving a flexibility to the sole at a location along the extension and in front of the boot.

An object of the invention is a ski shoe or boot which can be used with a binding of this type, whose sole includes a forward extension formed at the same time as the sole, by molding of plastic material. The forward extension of the boot which enters into the archplate is joined to the sole proper by a relatively flexible zone which makes it easier to raise the heel of the boot. The forward extension of the sole has a shoulder facing toward the boot. The fastening means engages this shoulder to fasten the boot to the ski.

The extension of the sole presents an area of lesser thickness to add flexibility to the extension, and the portion of the extension bounding this area can be used advantageously as a shoulder for engagement by the fastening means which secures the front portion of the extension of the sole in the archplate.

In a preferred embodiment of the boot according to the invention, the portion of the front extension engages in the fastening archplate, the extension having an upper beveled transverse rear edge, facing the boot and/or a lower beveled transverse leading edge at the front extremity of the extension.

These bevels enhance the extent of flex of the foot of the skier as the skier advances, because of the increased flexibility of the sole.

The invention has equally as its object a ski binding, particularly for a touring or cross country ski of the type mentioned above, characterized by the fact that it comprises a fastening means connected to the archplate and furnished with a moving part which can be brought against a projecting shoulder of the sole extension to assure fastening.

In one embodiment the binding means comprises a fastening member including a hook connected to the archplate and pivotable about a horizontal axis transverse to the axis of the ski. The tip of the hook can be moved between a first or fastened position, in which the tip of the hook is engaged against a shoulder of the sole extension which faces the boot, so that it prevents the extension from being disengaged from the archplate, and a second or unlocked position, in which the tip of the hook is disengaged from the shoulder to permit the separation of the boot from the archplate.

In this first embodiment of the invention, the hook is advantageously made in the form of a small metal plate mounted on two arms at the upper part of the archplate, the tip of the hook being the bent end edge of the small plate which engages the shoulder of the boot extension.

Preferably a spring, for example a helical spring, constantly holds the hook in the locking position.

According to a variation of this first embodiment of the invention, the hook is advantageously formed from molded plastic material. The hook is mounted on the upper part of the archplate by a leaf spring whose flexing permits the movement of the hook between the fastened and unfastened positions, and whose elasticity constantly holds the hook in the locked position.

In a preferred form of this variation the leaf spring has the general form of a square with an aperture in its center, one end of the square being fixed, for example by rivets, on the upper part of the archplate of the ski binding, while the other three sides seat in a cavity in the body of the plastic hook, a projection integral with the body of the hook engaging itself in the central aperture of the square and being secured by a pin passing through the body of the hook from one side to the other.

To assure a good fastening of the extension of the boot in the archplate it is preferable, according to the invention, that the tip of the hook have a relatively large width and that the two points where the hook is pivoted to the archplate be sufficiently spaced from each other to avoid any pivoting of the hook around an axis other than its own pivotal axis.

In a second embodiment the binding has as a fastening means, a lever capable of pivoting around a fixed axis on the archplate, a hook whose tip is engaged against the shoulder of the sole extension, the hook itself being joined to the lever along a pivotal axis situated in front of the axis joining the lever to the archplate, so that in lowering the lever toward the sole of the boot one causes the tip of the hook to engage and abut against the shoulder, while in raising the lever, one causes the hook to swing upward and free of the front extension of the sole.

According to a preferred embodiment, in the unlocked position the pivotal axis of the lever is above the pivot axis between the tip of the hook and the lever, while when in the locked position the pivot axis between the lever and the hook moves above the pivot axis of the lever so that the lever and the hook are in a state of equilibrium, and fixed in the locked position.

The lever advantageously has at least one stop which after a certain upward movement of the lever engages the hook to raise it and disengage it from the extending shoulder of the sole extension.

There can also be a return spring to push the hook downward in relation to the lever.

According to a variation of the second embodiment, the fastening member is a hook whose tip, located at one of its extremities, is capable of engaging itself against the shoulder of the forward extension of the sole of the boot and whose other extremity is connected to the support of the archplate by a double pivot lever. The pivot axis connecting the lever and the base of the archplate is situated between the tip of the hook and the pivot axis connecting the lever to the body of the hook. This provides an over center snap action during locking and unlocking in such a manner that the hook is kept elastically in the locked position.

According to a third embodiment, the locking means is constituted by a horizontal transverse bar which is able to be raised and lowered in relation to vertical sides of the archplate, the bar engaging against the shoulder of the sole extension to assure locking.

In a particular practical embodiment of the invention, the bar is integral with two arcuately curved arms which slide in grooves of corresponding form made in the vertical sides of the archplate, under the action of a swingable lever which is pivot to the end of said arcuately curved arms.

In a preferred variation of the third embodiment the upper part of the archplate includes two inwardly extending horizontal wings fixed on the vertical parts of the archplate and between which the lever can move during locking and unlocking.

In such embodiment the inner extremity of the lever engages the bottom of the horizontal wings to push the arms through the grooves in an arcuately curved path, and to assure the raising of the bar to a position above the boot extension, while sides of the extremity cam on edges of the wings to pull the arms in an arcuately curved path to the locking position.

Several embodiments of the invention will now be described, purely by way of illustration and example with reference to the accompanying drawings.

Figure 1:
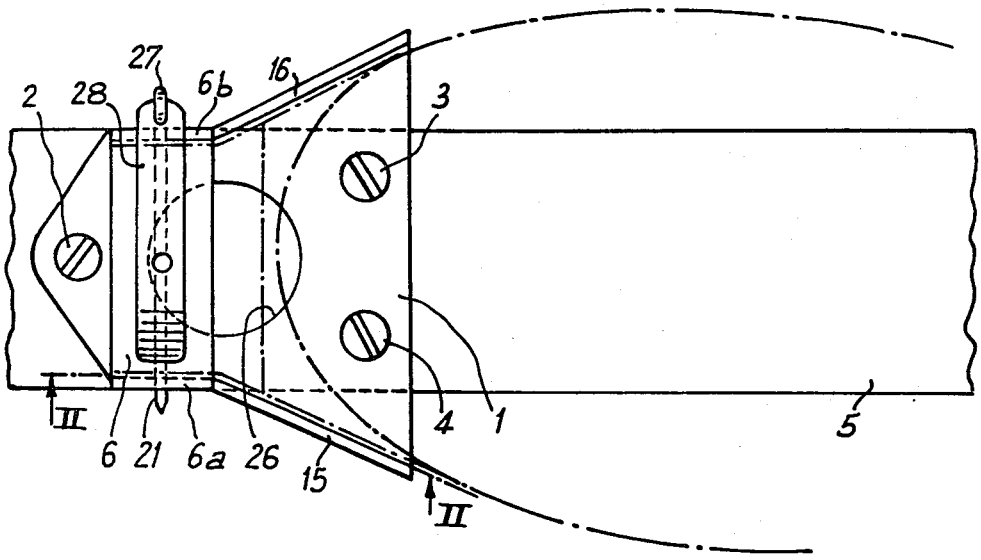
FIG. 1 is a top plan view of one embodiment of the ski binding of the invention.
Figure 2:
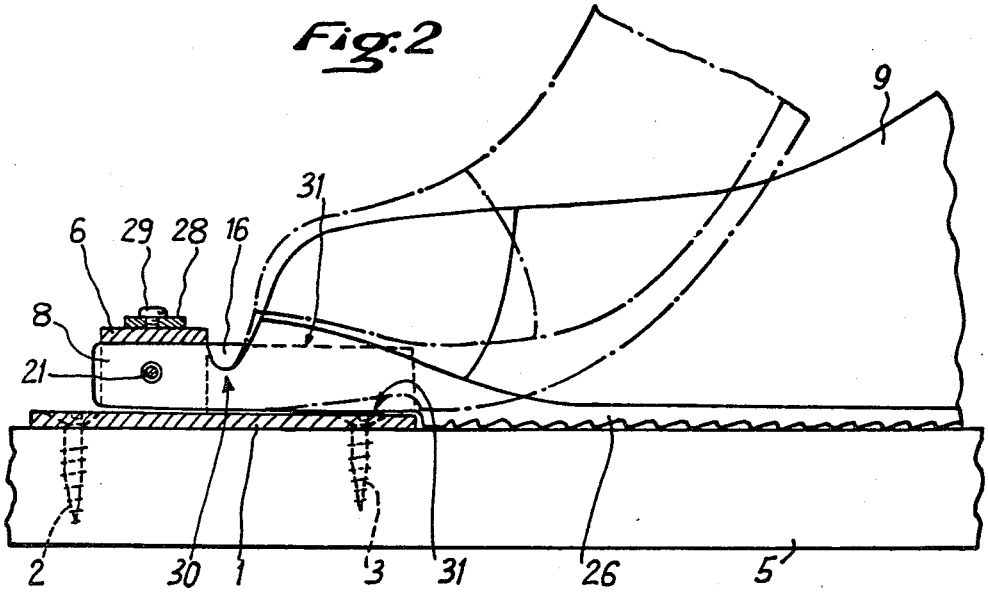
FIG. 2 is a side view taken along line II—II of FIG. 1.
Figure 3:
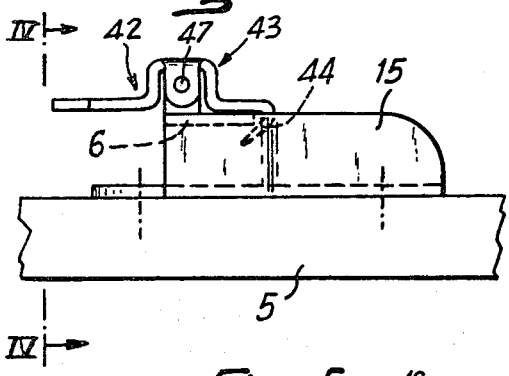
FIG. 3 is a partial view in front elevation of another embodiment of the ski binding according to the invention.
Figure 4:
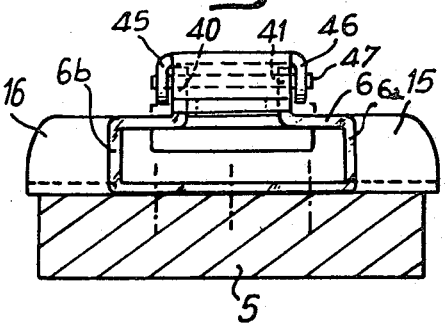
FIG. 4 is a sectional view taken along line IV—IV of FIG. 3.

In the binding of this invention shown at FIGS. 1 and 2, the locking member is constituted by a horizontal steel pin 21 which extends transversally through the rigid vertical sides 6*a* and 6*b* of the archplate 6 as well as through a horizontal opening in the front extension 8 of the sole. This pin 21 is held by a plastic strip 28 attached to the end 27 of the pin 21 and secured to the archplate by a knob 29 engaging a slot in the strip 28.

The plate 1 which supports the archplate 6 is fixed on ski 5 by screws 2, 3 and 4. The vertical sides 6*a* and 6*b* of the archplate are extended by divergent wings 15 and 16, which extend beyond the sides of ski 5, and receive the front of the boot and the sole extension between them as shown in FIG. 1 in phantom lines. An aperture 26 is made in base plate 1 in such a manner as to reduce its weight.

FIG. 2 shows the ski 5, base plate 1 integral with and which supports the metal archplate 6 and the wings 15 and 16. The sole 26 of the boot is provided with a forward extension 8 which is formed by molding the sole 26 in a single piece, for example by injection molding.

In this embodiment the sole 26 is joined to extension 8, fastened into archplate 6, by an area 30 of lesser thickness than the front of the extension, which area 30 gives a greater flexibility to the front of the boot. This facilitates the raising of the heel of the boot, by the skier, to the position shown by phantom lines.

As seen in FIG. 2, area 30 of lesser thickness forms a shoulder 27 facing toward the boot and which, according to the invention, can be used for fastening the extension in the archplate, as is the case for the embodiments which will now be described.

Figure 5:
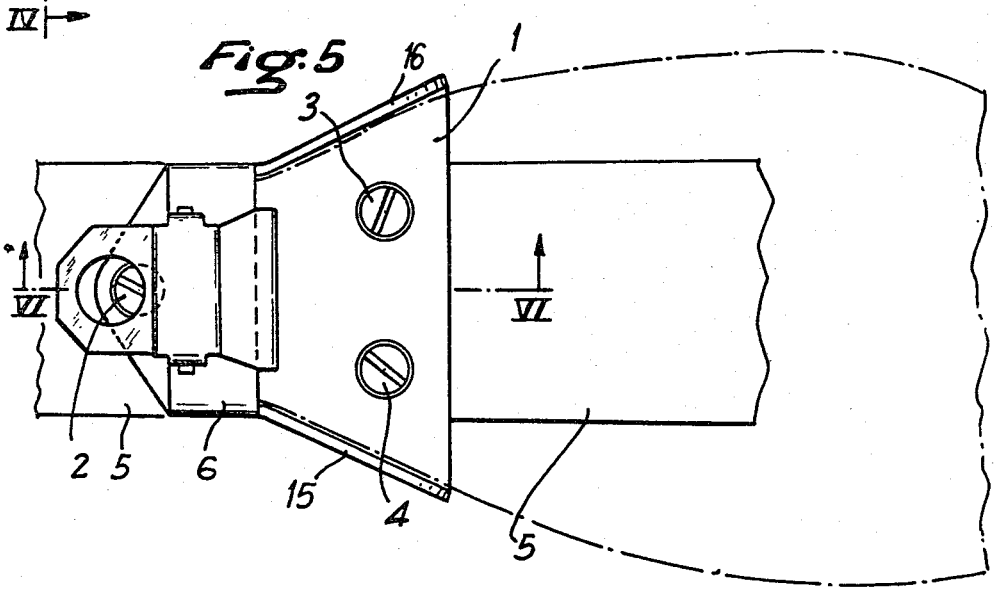
FIG. 5 is a plan view with portions removed of the binding of FIG. 3.

In all the embodiments there is a plate 1 which supports the archplate 6 and which is fixed to the ski 5 by screws 2, 3, and 4. The archplate of each embodiment has vertical sides 6*a* and 6*b* which are extended by divergent wings 15 and 16 to receive the front of the boot shown by phantom lines in FIG. 5.

The fastening member of one embodiment is shown in FIGS. 3 to 6. The upper part of the archplate 6 extends inwardly and upwardly to provide two wings 40 and 41 bent upwardly and having aligned openings to receive the pivot pin of hook 42. In this embodiment the hook is a metal plate bent to inverted U shaped at 43 appreciably in its middle so it passes around wings 40 and 41 and is free to pivot. At one free end, the hook is bent to form a locking tip 44.

Hook 42 also includes two vertically bent tabs 45 and 46 which have aligned openings to receive the pin 47 which goes through them from one side to the other and around which hook 42 pivots relative to archplate 6.

Figure 6:
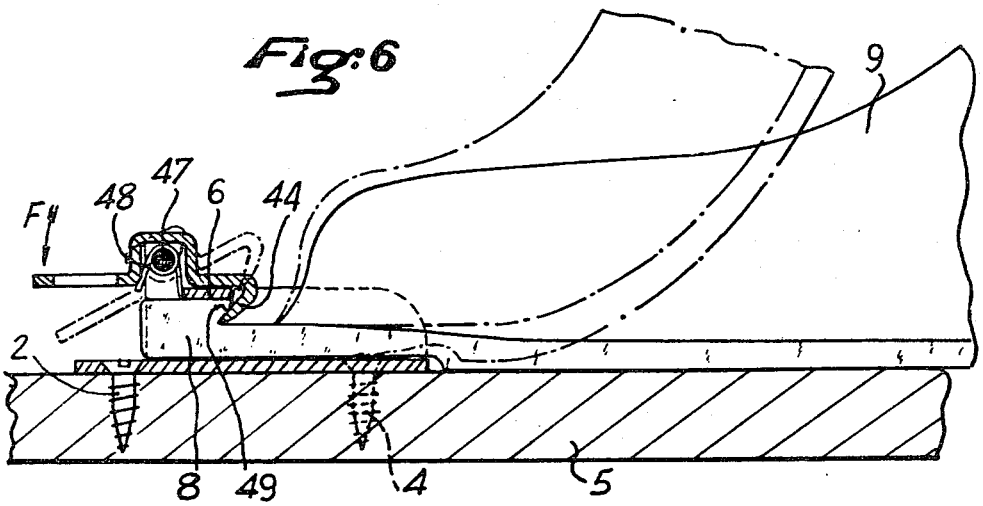
FIG. 6 is a sectional view taken along lines VI—VI of FIG. 5, and showing the boot being engaged in the binding.

A helical torsion spring 48 (FIG. 4) has one end engaging the edge of the archplate and its other engaging the hook body to constantly urge the hook clockwise, as viewed at FIG. 6, toward the fastened position of the binding. Therefore, it is clear that when one presses on the flat end of the hook, in the direction of arrow F (FIG. 6) the locking tip 44 is raised to the position shown in phantom lines, releasing extension 8 and permitting the boot to be withdrawn from the binding.

As can likewise be seen in FIG. 6, extension 8 of the sole of boot 9 includes a shoulder 49 against which tip 44 of the hook engages when the binding is in the fastened position.

In the embodiment shown in FIGS. 3 to 6, the plane of shoulder 49, and furthermore the plane of tip 44 of the hook (in the fastened position), are tangent to the circle centered on the pin 47. This permits swinging and easy disengaging of the hook, without requiring much clearance.

In the variation of FIGS. 7 to 11, the body 42 of the hook is made from molded plastic material, fixed to the archplate of the binding by a metal leaf spring 50 which is itself fastened by two rivets 51 onto the inwardly extending walls 6 of the archplate.

In this variation the leaf spring 50 has in its center part an opening 52 which permits the fastening of plate 1 on the ski by allowing access to screw 2 through this opening before the body 42 of the hook is mounted on leaf spring 50.

Figure 11:
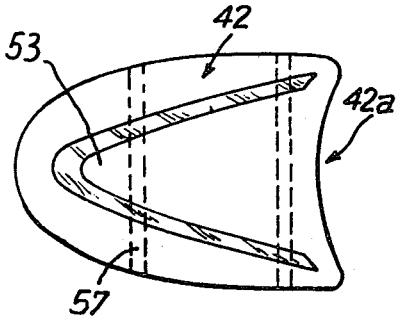
FIG. 11 is a top view of the body of the hook of FIG. 10.
Figure 12:
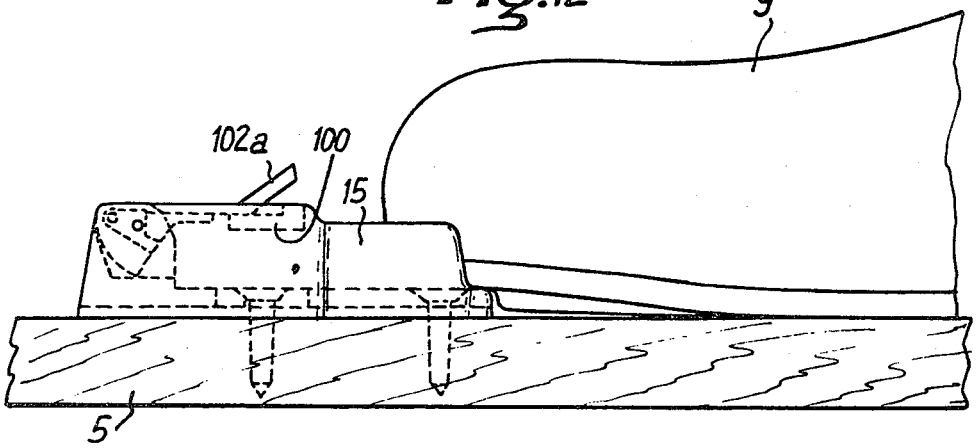
FIG. 12 is a side view of another embodiment of the binding according to the invention.
Figure 13:
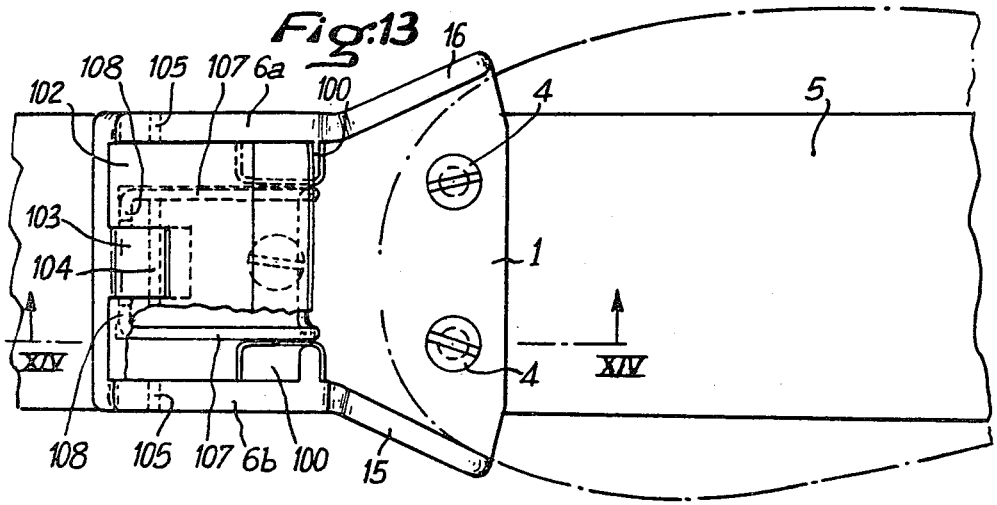
FIG. 13 is a top plan view of the binding of FIG. 12, with its lever partly cut away.

As shown in FIG. 11, which shows a top view of the body 42 of the hook, the body has the general form of a curvilinear isosceles triangle but with rounded corners. The apex of the body of the hook is pointed in the direction of the advancing of the ski. This assures a better sliding in the snow, while the rear edge 42*a* is concave so as to avoid rubbing of the end of the boot against the body of the hook when the skier moves his legs.

Figure 7:
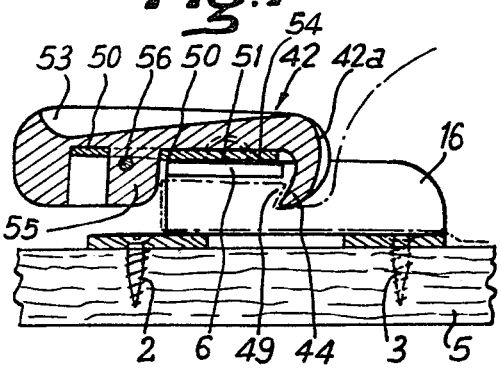
FIGS. 7 and 8 are side views in section taken along lines VII—VII of the embodiment of FIG. 9, and showing the binding represented respectively, in a locked position, and in an unlocked position.
Figure 8:
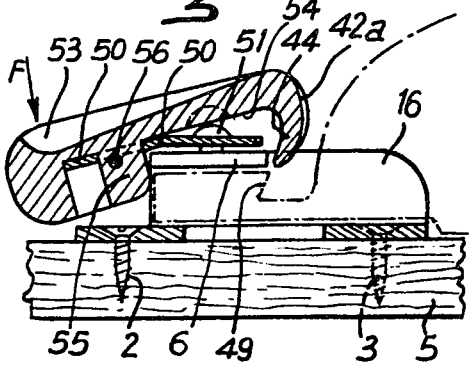

The top of the body of the hook likewise presents evidence of triangular form which can be seen on edge in FIGS. 7 and 8. This form constitutes a groove 53 for the end of the ski pole which one can use advantageously to bring the body of the hook into the unfastened position of FIG. 8.

Figure 9:
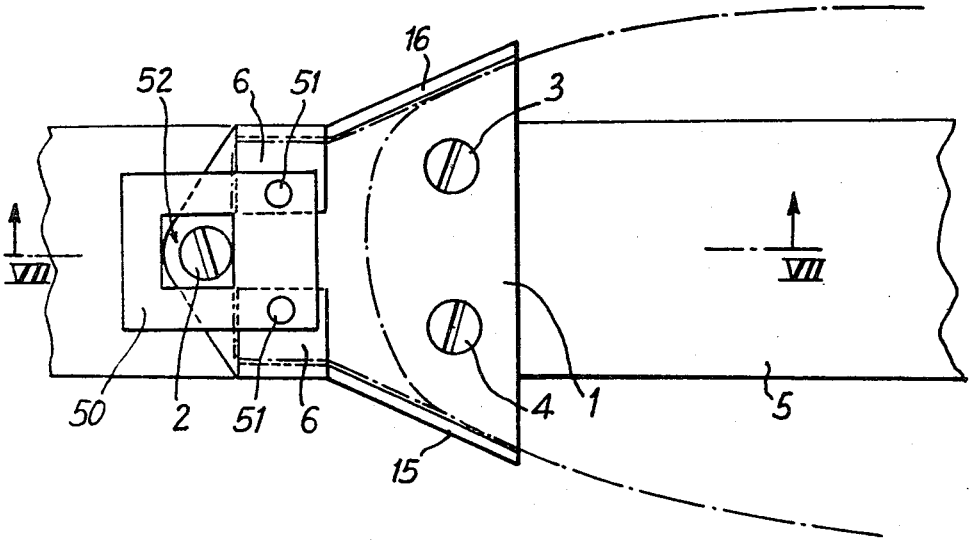
FIG. 9 is a top plan view of the embodiment of FIGS. 7 and 8, with the hook removed.
Figure 10:
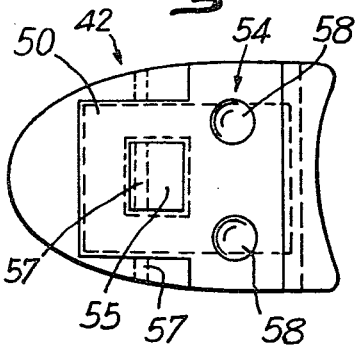
FIG. 10 is a bottom of the body of the hook of the binding of FIGS. 7 and 8.

As shown at FIGS. 7, 8 and 9, the body 42 of the hook presents on its inner part a transverse recess 54 designed to interlock with the archplate of the binding. Likewise, it presents a recess whose form corresponds to that of the leaf spring 50 and which is shown in dotted lines in FIG. 10.

Likewise, at its inner part, body 42 of the hook presents a rectangular projection 55 which is a close fit in the rectangular opening 52 made in the leaf spring 50.

As a result, body 42 of the hook is held against lateral movement on the spring.

To fasten the spring 50 to the body of the hook 42, a metal pin 56 is inserted through an opening 57 made in the body of the hook and in projection 55.

One perceives easily that in this manner one can mount the plate of the binding 1 on the ski, having access to screw 2 through opening 52 made in the spring 50. Then one places the body 42 of the hook on the spring 50 and finally, fastens the hook and the spring together with pin 56, which is just below the spring.

There are also two recesses 58 on the inner face of the body of the hook. The heads of rivets 51 enter them to permit the fastening of the spring 50 on the archplate of the binding in such a manner that the hook can move freely to the fastened position.

As in the embodiment of FIGS. 3 to 6, the tip 44 of the hook is inclined as well as the shoulder 49 of the extension of the sole of the boot.

In this manner one can understand that according to the two variations shown it is possible to automatically engage the sole extension in the archplate by raising the tip of the hook which falls back behind shoulder 49 and thus assures fastening.

Likewise one can understand that according to the invention, all that is needed to unfasten the boot is to press on the hook in the direction of arrow F.

In the case of the variation of FIGS. 7 to 11, this movement can be obtained with the help of the end of the ski pole. One engages the end of the pole in the recess 53 located at the front of the body 42 of the hook.

The triangular form of recess 53 (FIG. 11) guides the tip of the ski pole on the forward part of body 42.

Finally it is clear that if desired and to facilitate the introduction of the forward extension of the sole of the boot into the archplate, one can manually move the hook at the time of the introduction of the sole in the archplate.

In the embodiment of FIGS. 12–16, the upper part of the archplate is constituted by two wings or projections 100 which extend horizontally inwardly from the upper part of vertical sides 6*a* and 6*b* of the archplate in such a manner as to hold the extension of the sole against upward movement.

The assembly of the different elements of the archplate is molded in one piece out of plastic material. To augment the rigidity and the mechanical solidity of wings 100, the wings have ribs 101 which extend upwardly from their upper surfaces.

In this embodiment the upper part of the archplate is open in the middle. The function of the archplate is obtained by the two wings which hold the forward extension of the sole and keep it from lifting.

One can see in the drawing that lever 102, which in the present case is of molded plastic material, has a width which corresponds to the existing distance between wings 6*a* and 6*b*.

Hook 105 (FIG. 14) is a bent metal wire having the general form of a U. The central part of the U forms the tip 106 of the hook while the sides 107 which form the body of the hook are bent inwardly at 108 toward the inside to engage in corresponding openings in lever 102.

Figure 14:
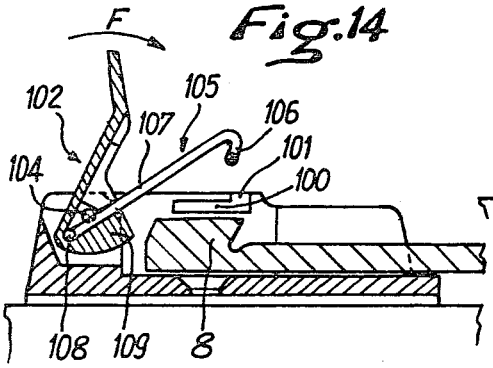
FIGS. 14, 15, and 16 are side views in sections taken along line XIV—XIV of FIG. 13 showing the lever and the hook in different positions.

As can clearly be seen, in particular in FIG. 14, two stops 109 at either side of lever 102 limit the downward movement of hook 105 in relation to lever 102 and permit hook 105 to be raised when lever 102 is moved up to a position in which the binding is unlocked and the hook is above extension 8.

Figure 15:
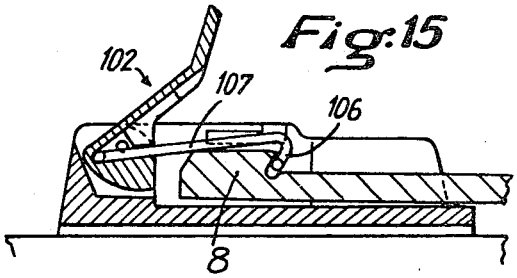
Figure 16:
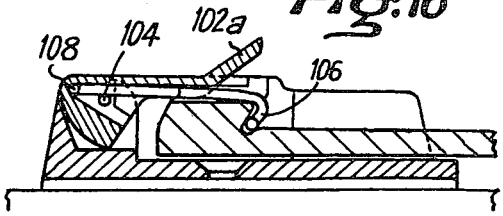
Figure 17:
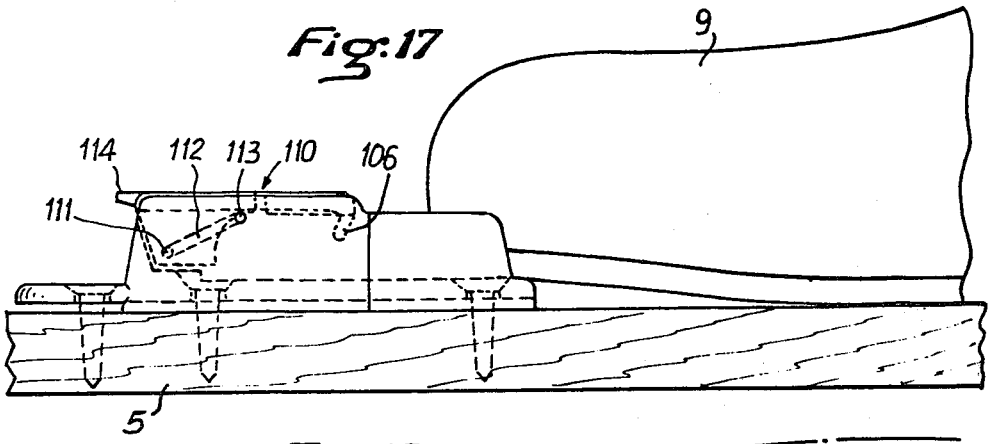
FIG. 17 is a side view of another embodiment of the binding according to the invention.
Figure 18:
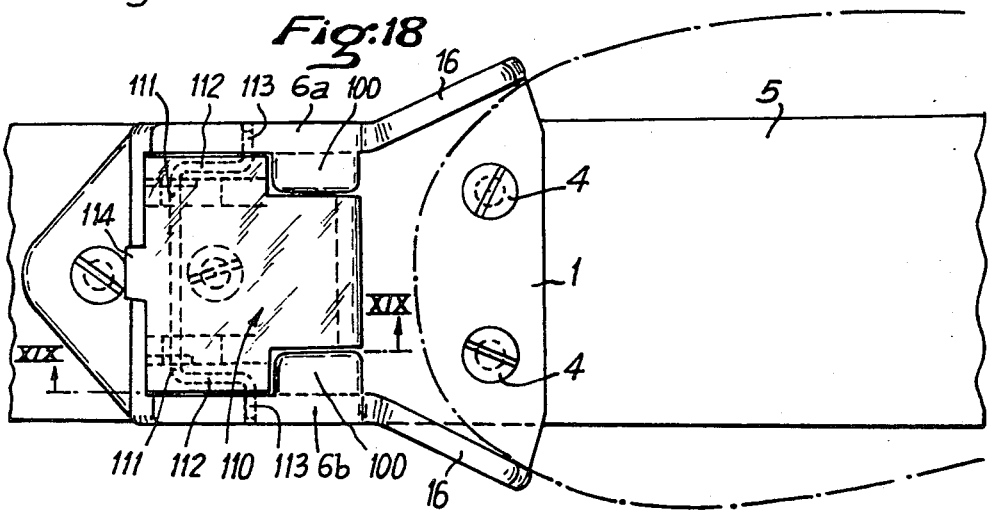
FIG. 18 is a top plan view of the binding of FIG. 17.

As can be seen in FIGS. 14, 15 and 16, hook 105 can pivot, around axis 108 in relation to lever 102, between two angular positions for which the line joining tip 106 of the hook to its pivot axis 108 is below the joining pivot axis 104 of the lever in one case (FIG. 14), and above it in the other case (FIG. 16).

In the position shown in FIG. 14, a lateral opening made in the lever permits the diverting of the sides 107 of the hook so as to be able to engage the corners 108 in the corresponding openings of lever 102 in which the hook pivots.

Proceeding to the binding of the boot to the ski, it suffices, after having placed the lever in the position of FIG. 14, to engage the extension 8 of the sole in the archplate. In this position, the sole extension is held against movement laterally by vertical sides 6*a* and 6*b* and is held against upward movement by wings 100.

Beginning with this position of the extension of the boot one can pivot lever 102 in the direction of arrow F, one causes first of all the simultaneous moving of hook 105 and of lever 102 to force the tip 106 of the hook behind the shoulder of extension 8 of the sole as is shown in FIG. 15. During this movement, wings 107 of the U which forms the hook pass between the two wings 100 of the upper part of the archplate.

One can also place a return spring between hook 105 and lever 102 in such a manner as to exert a slight force to separate the hook from the lever in a way so as to be sure that at the time of movement in the direction of arrow F and in spite of the friction which can intervene, the tip 106 of the hook becomes securely engaged behind the shoulder as shown in FIG. 15.

If one follows the movement of the lever, from the open position of FIG. 14, in the direction of the arrow F, the moving pivot 108 of the hook on the lever describes an arcuately curved path around axis 104 and exerts a forward pull (towards the left as seen in FIG. 15) until the axis of pivot 108 passes pivot 104. The lever can then be further pivoted by a small angle to take the position shown in FIG. 16 in which pivot 108 is above pivot 104 and which lightly relaxes the force exerted on the shoulder of the sole extension by the tip of the hook. In this last position the different parts are in equilibrium since the joining axis 104 of the lever is situated below the line which joins the pivot axis 108 of the hook with the tip of the hook.

To unfasten the boot lever 102 is moved in the opposite direction (counter-clockwise). A light force is necessary, beginning with the position of FIG. 16, to move the lever and to cause the pivot axis 108 to pass beneath the line which axis 108 makes with the tip of the hook. Continuing the movement of the lever counter-clockwise, one arrives at the position of FIG. 15 where the stops 109, integral with the lever, engage the sides 107 of the hook to raise the hook to the FIG. 14 position, completely freeing the extension 8.

Although the binding described is made of plastic material, it is clear that the invention can also be realized using metallic parts of appropriate form. In addition, in place of the hook which passes between the two wings 100 at the upper part of the archplate, the archplate can be completely closed, and a hook can be used which extends over the top of the archplate and whose tip is extended to engage the shoulder of the sole extension to assure the fastening of the binding.

In the embodiment of FIGS. 17–21, the upper part of the archplate is constituted by two wings 100 which extend horizontally inwardly from the upper ends of the vertical sides 6*a* and 6*b* of the archplate, so as to support the sole extension against movement upwardly. The archplate and wings can be advantageously molded in a single piece out of plastic material.

One can see in FIGS. 17 to 21 how a hook 110 provided with a tip 106 is mounted to pivot on the shaft 111 of a lever having parallel arms 112 at each side, and outwardly bent aligned fingers 113 which enter and pivotally mount the lever on the vertical sides 6*a* and 6*b* of the archplate. As shown, the lever is of one piece construction, and takes the form of a single metal rod bent to U shape and whose fingers 113 are bent outwardly.

Figure 19:
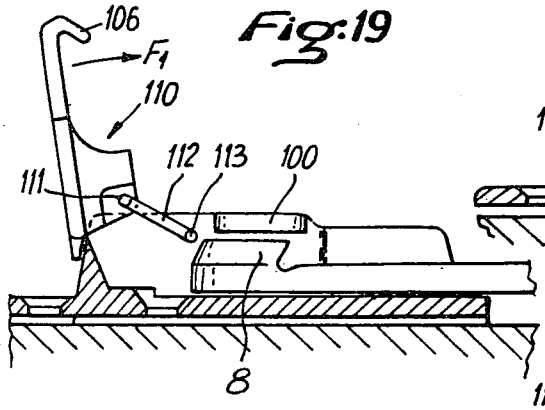
FIGS. 19, 20 and 21 are side views in section taken along the line XIX—XIX of FIG. 18 and showing the hook in different positions.
Figure 20:
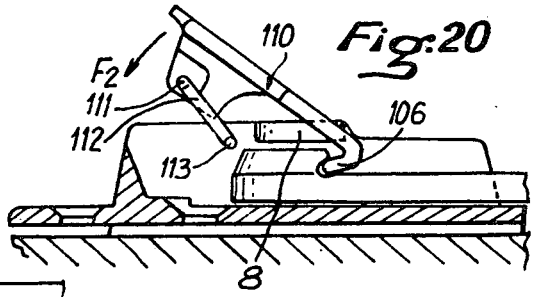
Figure 21:
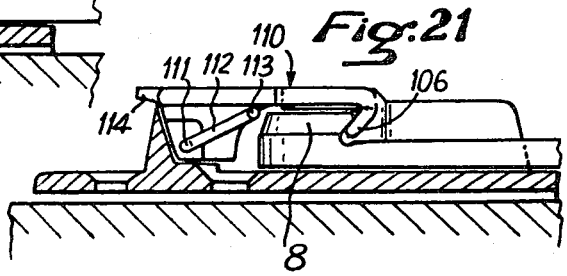

The sequence of positions that hook 110 can take to fasten the binding are shown in FIGS. 19, 20 and 21.

In the position shown in FIG. 19, in which hook 110 is raised, the forward extension 8 of the sole can be inserted in the archplate, to the position shown. For clarity of illustration this extension 8 of the sole is shown with a slight clearance between it and the archplate, but it is clear that according to the invention, the form of the forward extremity of the extension of the sole corresponds in height to the distance between the bottom surface of wings 100, and the top surface of the archplate.

To fasten the binding one swings the hook in the direction of arrow F1 to bring the hook into the position of FIG. 20 in which the tip 106 is resting against the shoulder of extension 8 of the boot sole. One notices that in this position, the axis of fingers 113 of the lever is between the tip 106 and the axis of shaft 111, and is slightly below the line joining axis 111 to tip 106 of the hook. The hook 110 can be brought to this position without having to exert any notable effort.

To proceed with the fastening of the binding, the hook 110 is pressed down to cause it to pivot around the tip 106 by exerting a force in the direction of the arrow F2. One can thus, due to the elasticity of the materials concerned, make the hook move around its own tip 106 and also around the axis 113 to bring it to the position in FIG. 21, in which the axis of fingers 113 is below the line joining axis 113 to tip 106 of the hook.

It is understood that due to the elasticity of the materials concerned, and such overcenter action, the position of the hook shown in FIG. 21 is quite stable.

To proceed to the unfastening, it suffices to exert a force in a direction opposite to the arrow F2 on tip 114, upwardly and toward the front of the boot.

Instead of using an archplate whose upper part is made of two wings 100, one can use an archplate having a solid part joining the wings with hook 110 then passing above the wings of the archplate and the tip of the hook, if slightly enlongated, would then be able to engage against the shoulder of the forward extension of the sole.

The device shown in FIGS. 22 to 26 is an embodiment of the fastening device in which a transverse bar engages the shoulder of the extension of the boot to assure the fastening.

Figure 25:
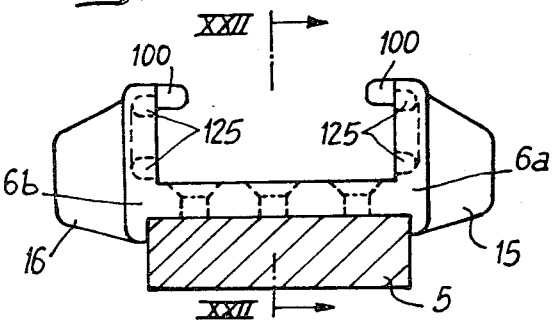
FIG. 25 is an end view of the archplate for binding of FIGS. 22, 23 and 24.

As shown at FIG. 25 the body of the binding is fastened to ski 5 and supports vertical parts 6*a* and 6*b* of the archplate to which includes divergent wings 15 and 16, as previously explained.

Vertical parts 6*a* and 6*b* support horizontal inwardly extending wings or extensions 100 which form the upper horizontal part of the archplate.

Figure 26:
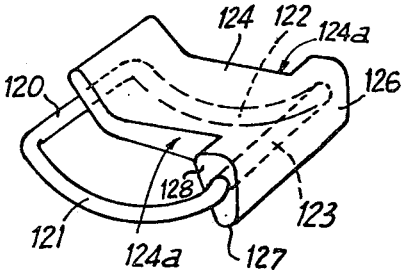
FIG. 26 is a view in perspective of the locking bar and of its control lever.

As shown at FIG. 26, the bar is integral with and at one extremity of two side arms 121 and 122. The other end of the two arms is integral with a shaft 123. Shaft 123 extends through and is pivotally joined to a front portion 126 of lever 124. Arms 121 and 122, which have an arcuately curved shape, slide in opposed grooves 125 of a curvature corresponding to the curvature of the arms. These grooves 125 are formed in the inside faces of the vertical sides 6*a* and 6*b* of the archplate. By virtue of the sliding action of arms 121 and 122 in grooves 125, bar 120 can be raised and lowered to unfasten and fasten the binding.

Figure 22:
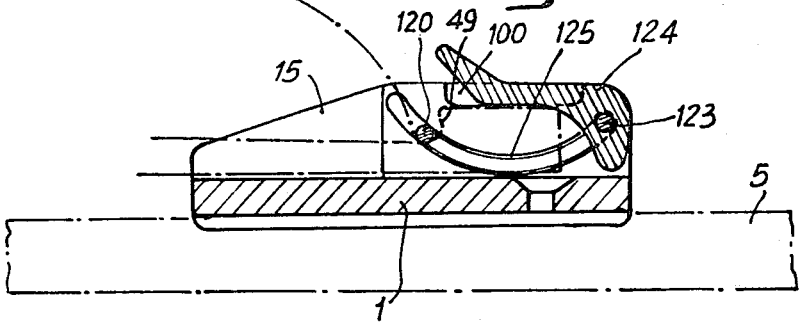
FIGS. 22, 23 and 24 are sectional side views taken along line XXII—XXII of FIG. 25 of another embodiment of the invention.

The body of lever 124 has recessed sides 124*a* to pass between the inside edges of wings 100 when the lever is moved to the closed position shown at FIG. 22. These recessed sides provide on front portion 126, cam surfaces 127 and 128. Front portion 126 also has a nose 130.

During fastening, lever 124 is moved counter-clockwise to the position of FIG. 22, after the extension of the boot is seated in the archplate. During such counter-clockwise movement the nose 130 of the lever engages base plate 1 to lift shaft 123 and thus pull bar 120 to the right, to the fastened position shown at FIG. 22. The cam surfaces 128, in the fastened position, engage behind edges 129 of wings 100 and cooperate with nose 130 which engages base plate 1 to prevent release of the binding.

Figure 23:
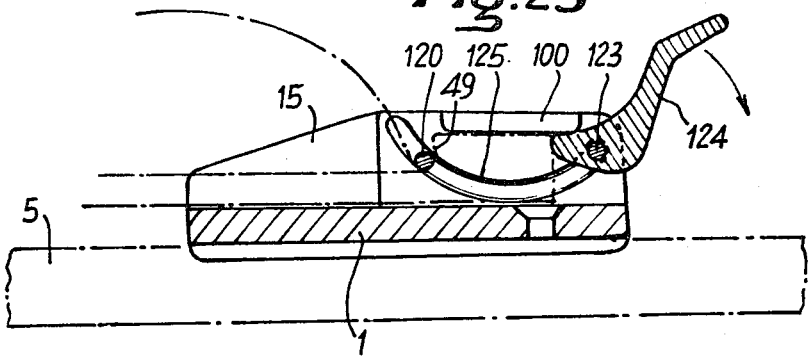
Figure 24:
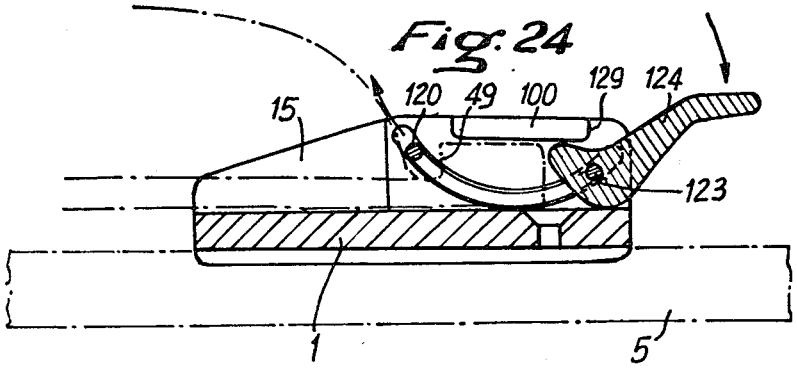

FIGS. 23 and 24 show the sequence of unfastening which occurs when lever 124 is moved in the direction of the arrows. When the lever reaches the position at FIG. 23, the inside cam surface 128 of front portion 126 engages the lower face of wings 100 to force the arms 121 and 122 to slide to the left in the grooves 125. This raises bar 120 to unfasten the binding.

It is thus apparent that in this embodiment, the front extension of the boot is held against withdrawal by the bar 120 because of the action and cooperation of lever 124 with wings 100 and base plate 1. It is also apparent that all the needed movement of bar 120 occurs simply by moving lever 124 to either of its extreme positions to either securely fasten or completely unfasten the binding.

Figure 27:
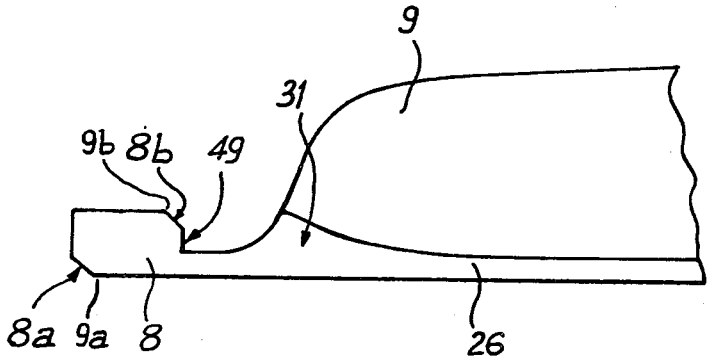
FIG. 27 is a side view of the sole extension according to a preferred embodiment.

FIG. 27 shows a preferred embodiment of the front extension 8 of the sole 26 of the boot. This extension preferably has a beveled lower front edge 8*a*, and a beveled rear upper edge 8*a* adjacent shoulder 49 which faces toward the boot. These beveled edges 8*a* and 8*b* permit a slight rolling action of the extension 8 in the archplate even though there is only the sufficient slight clearance between the height and width of the extension and archplate to permit insertion of the extension into the archplate. Such rolling action or increased flexibility is believed to occur in part from the slight flexibility of the material of the extension, and which permits slight localized deformation along the edges 9*a* and 9*b*, as the skier lifts the heel of the boot.

While several preferred embodiments of a binding according to the invention, and a ski boot having a sole with an integral extension for use with the binding have been shown and described, numerous changes can be made without departing from the scope of this invention as described herein and in the appended claims.

What is claimed is:

1. A ski boot of the touring or cross country type comprising, an integral forward extension of the sole of the boot adapted to engage in an archplate defining an opening of essentially the same cross-sectional shape as the extension and fixed to the ski, said extension providing an area of flexibility on the sole in front of the foot, said sole extension including a shoulder engageable by a fastening member on the archplate to hold the sole extension in the archplate of the binding.

2. A boot according to claim 1, wherein said shoulder faces the boot and defines in part a reduced thickness area between the boot and the portion of the extension which engages in the archplate of the binding.

3. A boot according to claim 1, wherein said extension of the sole which enters into the archplate of the binding has a beveled front lower edge.

4. A boot according to claim 1, wherein said extension of the sole which enters the archplate has a beveled rear upper edge.

5. A ski binding, especially of the touring or cross country type, in which the ski boot is held by a front extension of the sole of the boot which engages itself in an archplate secured to the ski, said archplate having a stationary horizontally extending upper part and defining an area whose form corresponds in width and height to that of the extension of the sole, fastening means connected to the archplate and including a fastening element movable downwardly from above said extension of the sole and engageable with an upwardly opening stop surface situated on an upper portion of the extension between the front of the archplate and the body of the boot to fasten the boot to the ski.

6. A ski binding according to claim 5, wherein, said stop surface includes a shoulder and said fastening means comprises a hook connected to the archplate and movable about a horizontal axis transverse to the length of the ski, the hook having a tip movable between a fastened position in which the tip of the hook is engaged against the shoulder of the extension of the sole to prevent the extension from disengaging from the archplate, and an unfastened position in which the tip of the hook is disengaged from said shoulder to permit the separation of the boot from the binding, and spring means continuously urging the hook toward the fastened position.

7. A ski binding according to claim 6, wherein said hook comprises a metal plate connected to two upright arms at the upper part of the archplate, said tip of the hook being integral with and bent from said plate.

8. A ski binding according to claim 7, wherein the hook joins the archplate at two joints sufficiently spaced from each other to assure all pivoting of the hook only around its pivotal connection with the archplate.

9. A device according to claim 6, wherein the tip of the hook has a width approximating the width of the extension of the sole.

10. A device according to claim 6, wherein said means for urging said hook toward the fastened position comprises a leaf spring connecting said hook to the archplate for pivotal movement of the hook between the fastened position and the unfastened position.

11. Device according to claim 10, in which the hook comprises a hook of molded plastic material.

12. Device according to claim 10, wherein said hook body has a recess and said spring seats in said recess, and pin means preventing movement of the spring out of the recess to secure the spring to the hook body.

13. Device according to claim 10, wherein said spring has a central opening to receive a projection of the body of the hook.

14. Device according to claim 5 wherein said fastening means comprises, a horizontal transverse bar, two arcuately curved arms integral with said bar, said archplate comprises upright sides with facing grooves of a curvature corresponding to said curved arms, said curved arms being disposed respectively in said grooves for sliding movement, and a lever connected to said arms at a location spaced from said bar and comprising means for moving the bar into engagement with the stop surface of the extension to fasten the boot to the ski.

15. A ski binding according to claim 14, comprising horizontal wings projecting inwardly from an upper portion of the archplate, said lever comprising a body having recessed sides movable between said wings.

16. A ski binding according to claim 15 in which said lever includes a nose camming against the under side of the horizontal wings of the archplate to move the bar to the raised unfastened position, and engaging the baseplate of the archplate to move the bar to the locked position.

* * * * *